United States Patent [19]

Manna et al.

[11] Patent Number: 5,025,598

[45] Date of Patent: Jun. 25, 1991

[54] MODULAR STRUCTURE FOR PARKING LOTS, PARTICULARLY SUITABLE FOR TEMPORARY PARKING LOTS

[75] Inventors: Biagio C. Manna; Luciano Spellucci, both of Rome, Italy

[73] Assignee: Centro Progettazioni Coordinate S.r.l., Italy

[21] Appl. No.: 485,386

[22] Filed: Feb. 26, 1990

[30] Foreign Application Priority Data

Jul. 3, 1989 [IT] Italy ..... 35852/89[U]
Jul. 3, 1989 [IT] Italy ..... 35854/89[U]

[51] Int. Cl.[5] ..... E04B 9/00

[52] U.S. Cl. ..... 52/126.6; 403/174; 403/175

[58] Field of Search ..... 52/126.6, 126.7, 127.6, 52/126.5, 174, 175; 403/171, 174, 175, 176, 178, 217

[56] References Cited

U.S. PATENT DOCUMENTS 4,277,923 7/1981 Rebentisch et al. ..... 52/126.6
4,685,258 8/1987 Au-Zuk ..... 52/126.6
4,922,670 5/1990 Naka et al. ..... 52/126.6

*Primary Examiner*—David A. Scherbel
*Assistant Examiner*—Creighton Smith
*Attorney, Agent, or Firm*—Samuels, Gauthier & Stevens

[57] ABSTRACT

A modular structure for building parking lots, which is particularly suitable for building temporary parking lots, in which structure each basic modular unit comprises: a rectangular or square composite floor slab (3), four edge beams (4) along the sides of the said slab, four node elements (5) at the corners of the slab (3) for supporting the edge beams (4), four vertical pillars (6) below the said node elements (5), for bases (7) for supporting the structure on the ground below the said vertical pillars (6), a number of ties (8) and/or struts for bracing the structure, the bases (7) comprising means for adjusting the length of the pillars (6) and means for adjusting the position of the base plate with respect to the vertical position of the pillars (6).

17 Claims, 8 Drawing Sheets

MODULAR STRUCTURE FOR PARKING LOTS, PARTICULARLY SUITABLE FOR TEMPORARY PARKING LOTS

This invention relates to a modular structure for building parking lots, which is particularly suitable for temporary parking lots. More particularly, this invention relates to a modular structure that can be easily assembled or disassembled for building a parking lot, also temporarily, on an already existing parking area or on an unexploited area.

The lack of areas for use as parking lots in zones where there is a high density of buildings is a well-known problem. It is also well known that the seemingly most obvious solution to such problem, namely the construction of underground or raised car parks, quite often cannot be adopted because of practical difficulties, or because of economic drawbacks due to the high costs of realization.

In such a situation, the possibility of obtaining rapidly and at low costs additional raised parking places on already existing surface parking areas or else raised parking places on areas that cannot be employed for parking areas, e.g. in parks or gardens, in the event that a temporary parking place is desirable, or on grounds too uneven to be practicable, or on archaeological sites, etc..

In particular, an easily assemblable parking structure appears to be very useful for temporary solutions, e.g. in connection with public occurrences, shows or sports events that generate large crowds, or else for temporary arrangements during works that require closing or reduction of already existing parking places.

One solution to the above-mentioned problem is proposed in GB-A-2189274, which discloses an assemblable structure for building parking places, adapted to be placed on a flat surface, comprising a plurality of vertical pillars each having a fixed base plate at its lower end and two or more connecting portions at its upper end, for connection with horizontal beams. The beams, which are welded directly to said pillars or connected by means of nuts and bolts to said connecting portions, are arranged so as to form a horizontal network on which a plurality of upper plates are placed, so as to form a raised floor for use as a parking area. In one particular embodiment the structure also has horizontal brace members lying on the ground and connecting the lower end portions of the pillars to each other, so that a rigid parallelepipedal cage-like structure is formed.

The resulting assembly is rigid in all its elements and connections, so that it cannot be adapted to possible unevenness of the land, and requires a perfectly flat and horizontal surface which, more often than not, needs to be compacted to increase the load-bearing capacity of the ground in question. Furthermore, the described structure seems excessively heavy, resulting in both the above-mentioned necessity to prepare the ground and in an overabundant use of material. Finally, the horizontal brace members used as a reinforcement are an obstacle for the vehicles at the ground floor.

Accordingly, it is an object of the present invention to provide a modular structure for building parking lots, composed of a few basic parts, whose structure can be easily assembled and disassembled, and does not require accurate leveling and smoothing out or any other particular preparation of the ground prior to setting up.

A framework of a provisional kind as is the one of the present invention must be assemblable in a very short time without requiring particular work for preparing the ground, and must be made of standard elements, all equal to each other irrespective of their position in the structural plan. Moreover, said framework must be such as to allow the assembly in any sequential order of the upper horizontal load-bearing structure.

In particular, the vertical pillars and the bases thereof must be such as to absorb differences in the ground level and slopes, while affording, when necessary, a perfectly horizontal and flat plane at the upper floor. The height of the pillars must be adjustable on the spot as must be the verticality of the pillars with respect of the base plates.

Another critical aspect of a structure like the one in question is the design of the capitals or node elements placed on top of the pillars for connecting the latter with the beams. These elements should not be integral with the pillars themselves, so as to avoid problems of the orientation of the pillars when setting up the structure. Moreover, separate pieces make manufacturing and transportation easier.

One of the simplest possible solutions is a node element consisting of a central tubular member that can be coaxially inserted in the upper end of the pillar, and has some connecting plates or eye hooks welded around its body for connection with the lateral tie-rods or struts of the structure, and a horizontal plate welded on its upper surface for supporting the beams converging on the pillar. The beams must be connected to each other by means of angular plates, each one fixed to two converging beams by means of nuts and bolts. The assembly of the various elements of the upper horizontal structure is particularly complicated, and, moreover, it is not possible to disassemble and change one element of the structure independently of the others, as the case might be when one damaged element is to be substituted by a new one.

Taking into account the above-mentioned drawbacks and requirements, there is provided, according to the present invention, a structure in which a composite basic module can be distinguished, said composite module consisting of a raised plane portion with the relevant supporting structure. In order to build the parking lot, each one of said modules is assembled on the spot starting from the elements it is made up of, and a number of modules are put side by side so as to obtain the desired configuration. It is well evident that the structure, in addition to the raised plane or floor for parking, for transit and for maneuvering vehicles to the parking places, is also comprised at least of one access and/or exit ramp which connects said plane or floor to the ground level.

Below the raised surface mentioned above there is a similar ground area, on which the supporting elements of the structure rest; said area can also be employed for parking.

Accordingly, the present invention specifically provides a modular structure for parking lots, particularly suitable for temporary parking lots, comprising a number of basic modular units, each one of these said units, taken separately, comprising a rectangular or square composite floor slab, four edge beams along the sides of said slab, four node elements at the corners of the said slab, four vertical supporting elements or pillars below each one of said node elements, and four bases below each one of the said vertical supporting members, characterized in that each one of said units also comprises a number of ties and/or struts for bracing the structure, connected at their ends to said node elements and said bases; and in that each one of the said bases, which incorporate means for adjusting the total length of said vertical supporting elements, comprises a flat base plate, a cylindrical collar rigidly fixed in the centre of said base plate, the axis thereof being perpendicular to the plane of said plate, one or more reinforcing elements for stiffening the connection between the said base plate and said collar, a first hinge member in the shape of a spherical segment, resting on the said base plate within the said cylindrical collar with its convex side upwards, a cylindrical pivot externally threaded of a smaller diameter than said cylindrical collar and having, at its lower end, a second hinge member in the shape of a spherical segment complementary to the first one and with its concave side downwards, said lower end of said cylindrical pivot being inserted in said cylindrical collar, and an internally threaded sleeve fitting said cylindrical pivot and coupled externally with the hollow lower end of said vertical supporting element.

In the structure of the present invention, two adjacent modules share an edge beam and the two relevant node elements, the two vertical supporting elements and their bases, as well as the ties and/or struts possibly present, so that in the whole structure only one node element is present and only one supporting element and base is present for each point into which four (or three, or two, as the case may be) contiguous modules converge.

Instead of providing horizontal braces joining the bases to each other and rigid connections between the various elements of the structure, in the present invention there is provided a bracing for reinforcing the structure against horizontal loads and impacts. Said bracing is made of a plurality of ties and/or struts, which may be hingedly and releasably connected with one end to one node element and the other end to the base of the adjacent pillar, or to the base of the same pillar, or else with one end to one node element and the other end to the node element placed at the opposite corner of the module.

The special construction of the base realizes a hinged joint between the vertical supporting elements and the base plate, so that the latter may be inclined while the former is perfectly vertical. Moreover, the total length of each pillar can be adjusted by acting on the threaded joint between the stud resting on the base and the sleeve fixed to the body of the pillar. These two features result in the possibility of absorbing the unevenness of the ground, as well as slopes or differences of level, thus adapting the proposed structure to the actual conditions of the site.

In one preferred embodiment of the structure of the invention, each one of the said node elements comprises a first tubular section coaxially insertable in the hollow upper end of the said vertical supporting element, having, regularly spaced out around its external surface, first pierced connection plates or eye hooks for connection with said ties and/or struts, a horizontal plate for supporting said edge beams, fixed at the upper end of said first tubular section and a second tubular section over said plate, integral and coaxial with said first section, having second pierced connection plates for connection with said edge beams, regularly spaced out around its external surface, lying in vertical planes slightly shifted with respect to the axial planes.

Instead of being connected with each other, the beams are joined to the connection plates of the node member by means of nuts and bolts, so that each beam can be easily assembled and disassembled, independently of the other elements of the structure. In particular, this solution allows the removal of one beam from the structure with no need of disassembling the other elements.

The four upper connection plates (namely, the second pierced connection plates) are not lying in two crossing axial planes as it may seem at first sight, but are on four planes parallel to said axial planes and slightly shifted therefrom, thus allowing the adjacent beam cores to be exactly centered with respect to the node element.

Returning to the bases of the proposed structure, said one or more reinforcing elements are preferably only one element, shaped in the form of a truncated cone or truncated pyramid or in the form of a section of sphere or ellipsoid, with a central hole exactly matching with the external surface of said cylindrical collar, inserted around said collar with its convex side upwards, and welded along its base perimeter to the said flat base plate. This solution is particularly advantageous in view of the considerable reduction of the possibility of damaging or hampering the vehicles that circulate on the ground floor. As a matter of fact, the vehicles' tires can smoothly climb on the base plates and on the reinforcing elements without being damaged by sharp edges.

A more economic alternative solution is, however, the one in which said one or ore reinforcing elements number are four or more vertical flat plates lying on symmetrically spaced axial planes, each one of the said plates being welded with its lower edge to the said flat base plate and with its vertical edge to the external surface of the said cylindrical collar.

Preferably, the said base also comprises, welded to the external surface of the said cylindrical collar at its upper end, the third pierced connection plates or eye hooks for connection with said ties and/or struts. Moreover, the said base can also comprise an outer sleeve for protecting the said threaded pivot and sleeve and the adjustable joint resulting therefrom, said outer sleeve being slidably coupled to the lower end of the said vertical supporting element and being sufficiently long as to completely cover the section between the said lower end of the vertical supporting element and the said one or more reinforcing elements of the base. The slidable sleeve may be raised, thus uncovering the threaded joint, when setting up or adjusting the structure, while in its normal lowered position it completely covers the joint.

In one specific embodiment, the said flat base plate is provided with two or more holes for connection to the ground. It is to be pointed out, however, that the proposed structure does not call for any foundation or prior ground preparation.

The node element of the assembly is generally adapted to join beams of different sizes: for the maximum size envisaged it is sufficient to place the beam onto the said horizontal supporting plate and to connect its core with the said pierced connection plate by means of nuts and bolts, while for beams of a smaller size a spacer of the required thickness must be placed on the said horizontal plate and fixed to it, supporting the beam in the correct position with respect to the connection plate. Specifically, the said node element also comprises, fixed onto the said horizontal plate, one or more additional supporting elements, each one below one of the said second pierced connection plates, with a flat upper surface for supporting edge beams having a cross-section smaller than the maximum one envisaged. Preferably, said additional supporting elements have the shape of a reversed U, and are provided at two opposite positions below the relevant connection plates.

The modular structure of the invention also comprises, as it is obvious, one or more inclined passages for use as entrance and/or exit ramps, as well as other optional fittings, like safety fences on the upper floor, wheel stoppers or locking means for the vehicles and supporting elements for lighting.

Moreover, the parking lot can also be endowed with the necessary structures for guarding the area, for check points, for automatic cash-desks, transit bars or any other element required for the management of the parking lot.

The most convenient sizes for the basic module are those corresponding to two parking places put side by side, preferably 5×5 m; a module of such sizes can be used indifferently as a parking module for two vehicles or as a vehicle transit element as a one-way driveway, for maneuvering cars to the parking places.

The structure, both as regards the support members and the auxiliary members, is preferably metallic and can be galvanized for protection purposes: if required, it is protected against fire by painting, the elements with an intumescent paint.

The transit and parking slabs are preferably made of corrugated iron or the like, covered by smooth sheets of wood or ply-wood, and/or synthetic material.

This invention will be described below just for illustrative and not for limitative purposes, with particular reference to some specific embodiments thereof which are illustrated in the enclosed drawings, wherein.

Figure 1:
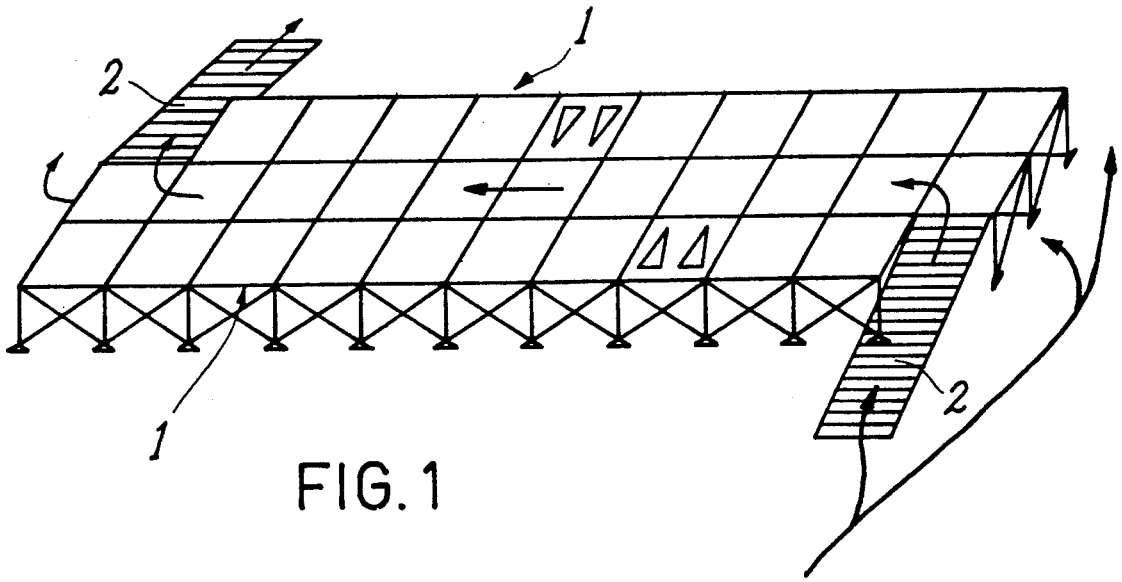
FIG. 1 shows a schematic perspective view of a parking lot realized with the structure of the present invention.

An example of a parking place built with the structure of the invention is schematically shown in FIG. 1: the upper floor of the parking place is obtained by combining a number of basic modular units 1 side by side, and by adding to the assembly two ramps 2 for entrance and exit. The vehicles can circulate in the sense shown by the arrows. The triangles schematically represent one parking place. The ground floor can be provided with parking places as well or, in special cases, it can be left unexploited.

Figure 2:
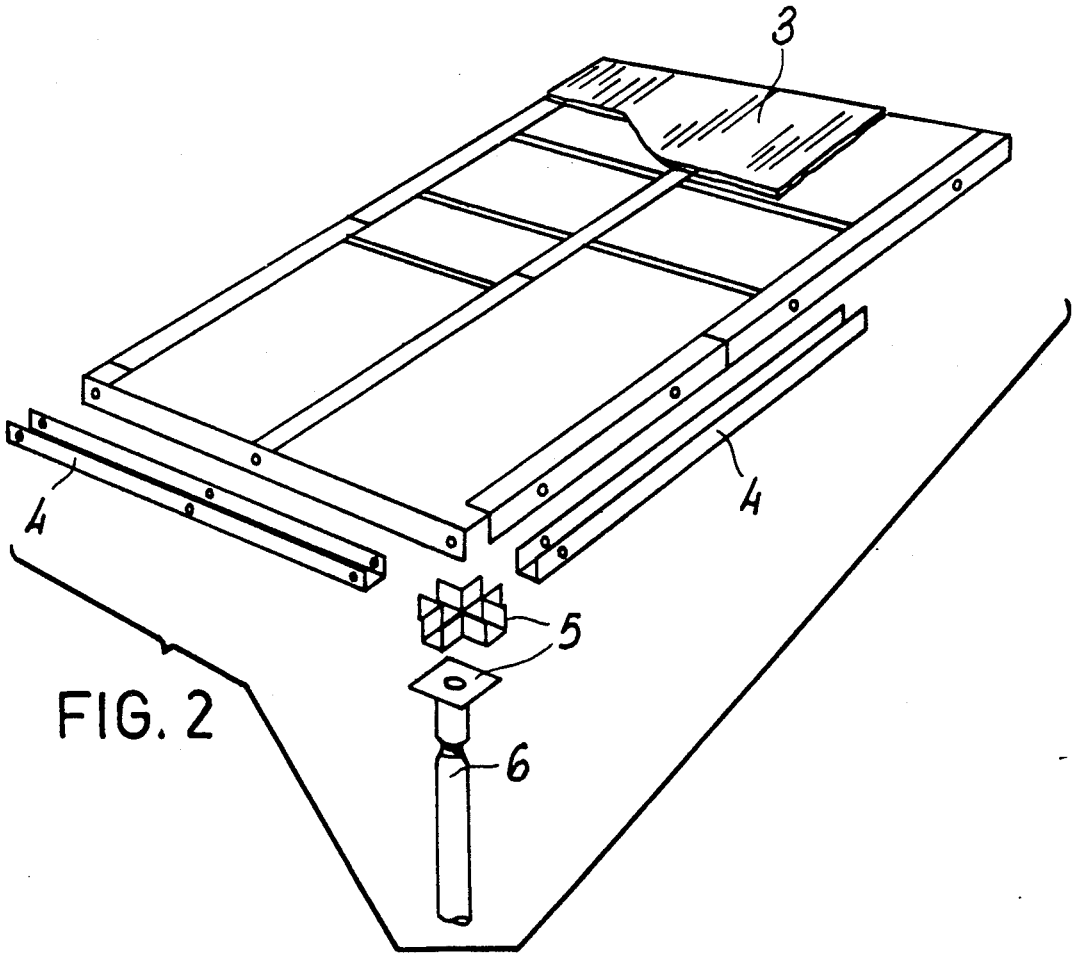
FIG. 2 shows a schematic perspective exploded view of an embodiment of some of the elements composing the modular unit of the structure according to the invention.

As it can be seen in FIG. 2, each modular unit comprises a composite floor slab 3 (partly cut away), which can be assembled directly on the spot. The floor plate 3 is preferably made of two layers of different materials, e.g., corrugated iron sheet and epoxy resin coated plywood panels, the latter constituting the exposed surface.

The other basic elements of the modular unit 1 are (FIGS. 2 and 3): four edge beams 4 (4*a* and 4*b* in FIG. 3) along the sides of the floor slab 3, four node elements 5 at the corners of said plate, four vertical supporting members or pillars 6, each one below the corresponding node element 5, four bases 7 for supporting the structure on the ground (not shown in FIG. 2), and suitable bracing elements for transverse stiffening of the pillars 6, said systems consisting of ties 8 in the case shown in the FIG. 3.

Figure 3:
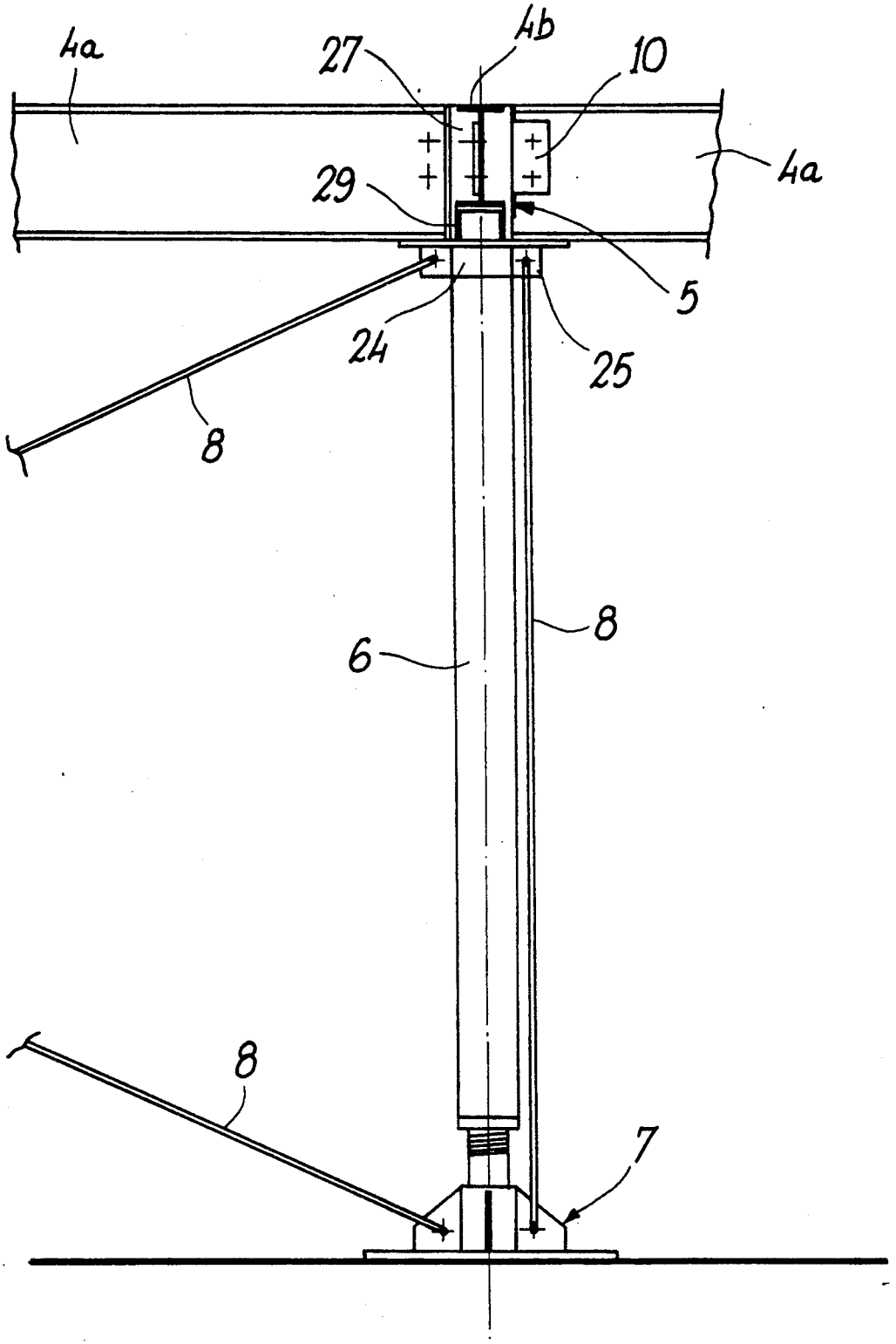
FIG. 3 is a front elevation of a section of another embodiment of the structure of the present invention.

FIG. 3 shows a base 7 of the same kind as the one appearing in FIGS. 7 to 9, which will be dealt with in the following. However, the preferred embodiments for the bases of the invention are the ones shown in FIGS. 4 to 6: a cylindrical collar 9 is fixed on a square base plate 10, having holes 11 for connection to the ground. A first hinge element 12, in the form of a section of sphere, is placed inside the collar 9. The first hinge element 12 is coupled with a second hinge element 13, complementary to the first one, fixed at the lower end of the threaded pivot 14.

The two hinge elements 12 and 13 can be made by casting or moulding, and the second one 13 can be joined to the pivot 14 by welding. The two hinge elements 12 and 13 can be fastened to each other, once their relative position is set, by means of a nut and bolt, passing through the two holes 15 and 16, provided on each one of the said elements. One of the two holes is in the form of a slot (not shown), so that the two parts of the joint can be blocked in an inclined position.

The pivot 14 is externally threaded at its upper end 17, and the thread may have any profile, provided that its size is sufficient to bear the weight of the structure it has to support. The threaded pivot 14 is coupled with a sleeve 18 internally threaded, and the two elements constitute an adjustable joint for adjusting the total length of the pillar 6. The hollow lower end of the pillar 6 is connected to the threaded sleeve 18 around the external surface thereof.

Figure 5:
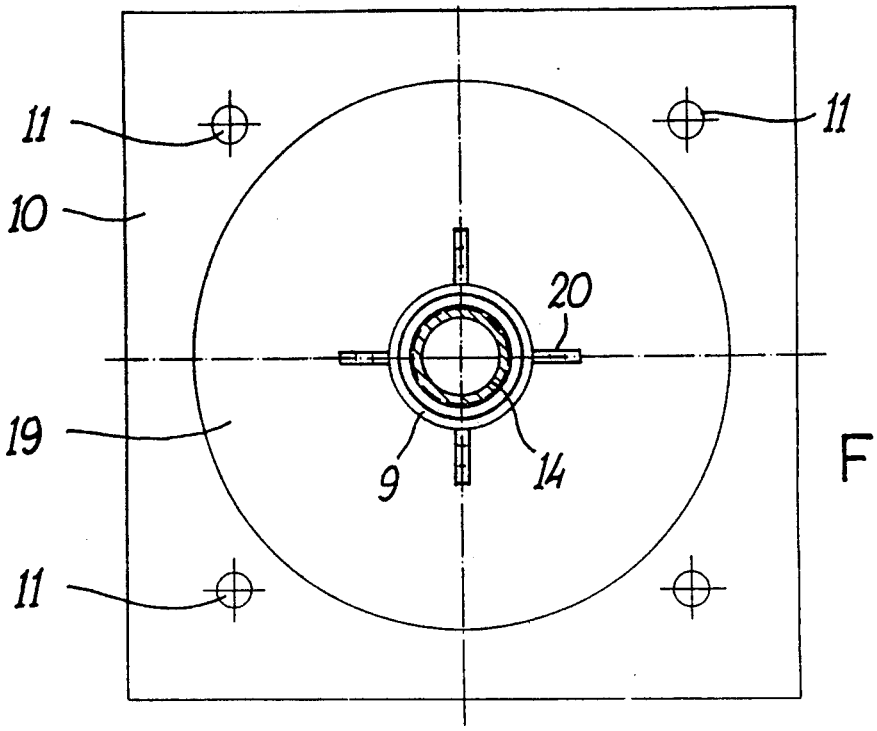
FIG. 5 is a cross-sectional view of the same base, taken along line A—A of FIG. 4.
Figure 4:
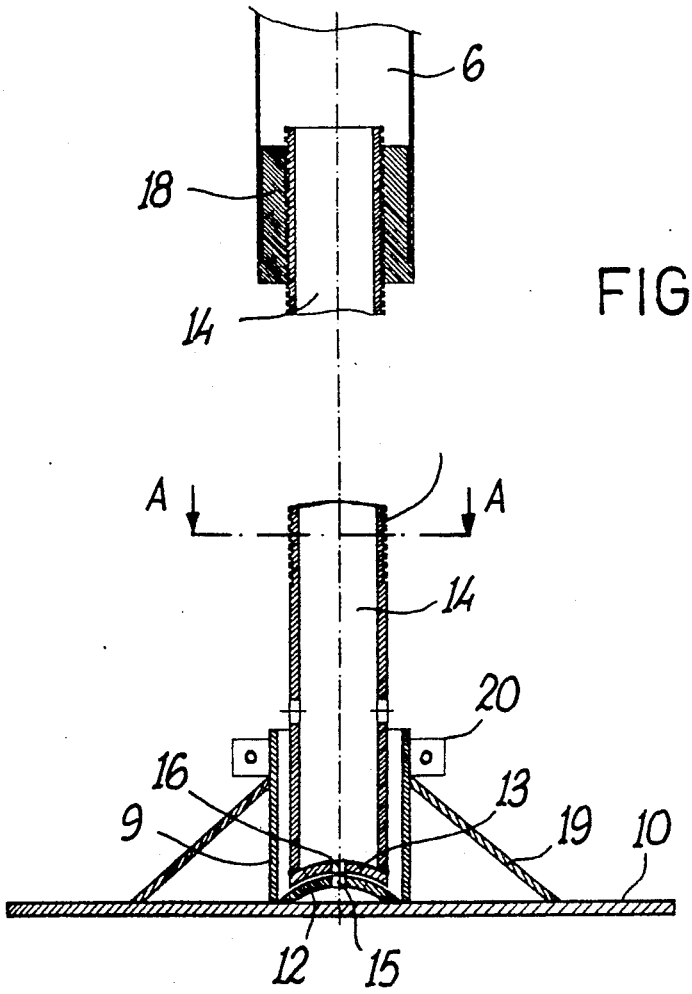
FIG. 4 is a longitudinal sectional view of a base according to the invention.
Figure 6:
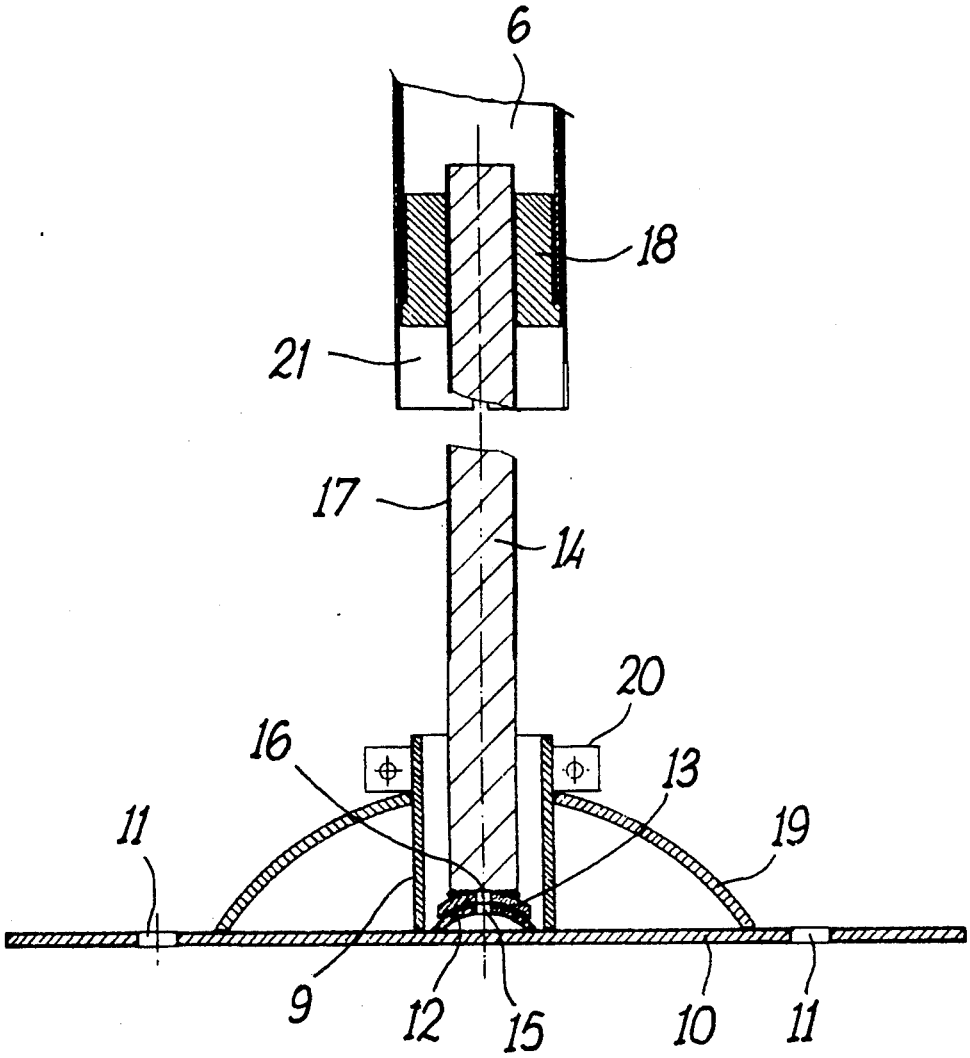
FIG. 6 is a longitudinal sectional view of a second base according to the invention.

The connection between the cylindrical collar 9 and the base plate 10 is stiffened by a reinforcing element 19 which in the base of FIGS. 4 and 5 has the shape of a truncated cone and in the base of FIG. 6 is a section of a sphere with a central hole. In both cases the reinforcing elements 19 are welded to the base plate 10 and to the collar 9.

The two bases shown are also provided with four pierced connection plates 20, each for connection with the ties 8 of the bracing or with struts, as the case may be.

While the pivot 14 of the base of FIGS. 4 and 5 is made of a tubular post, the one shown in FIG. 6 is a solid rod. Another difference between the two bases is the presence of the outer sleeve 21 in the base of FIG.

6. Said sleeve can slide around the external surface of the pillar 6, so as to uncover the threaded joint when raised and to protect it from damages and tampering when left in its lowered position. The outer sleeve 21 may have vertical slots at its lower end corresponding to the connection plates 20, in order to abut on the reinforcing element 19.

Figure 7:
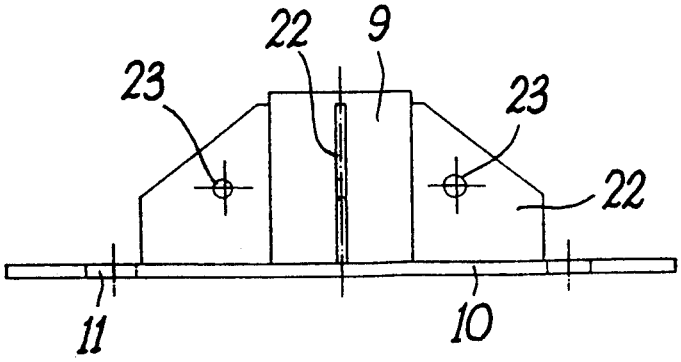
FIG. 7 is a front elevation of part of a third base according to the invention.
Figure 8:
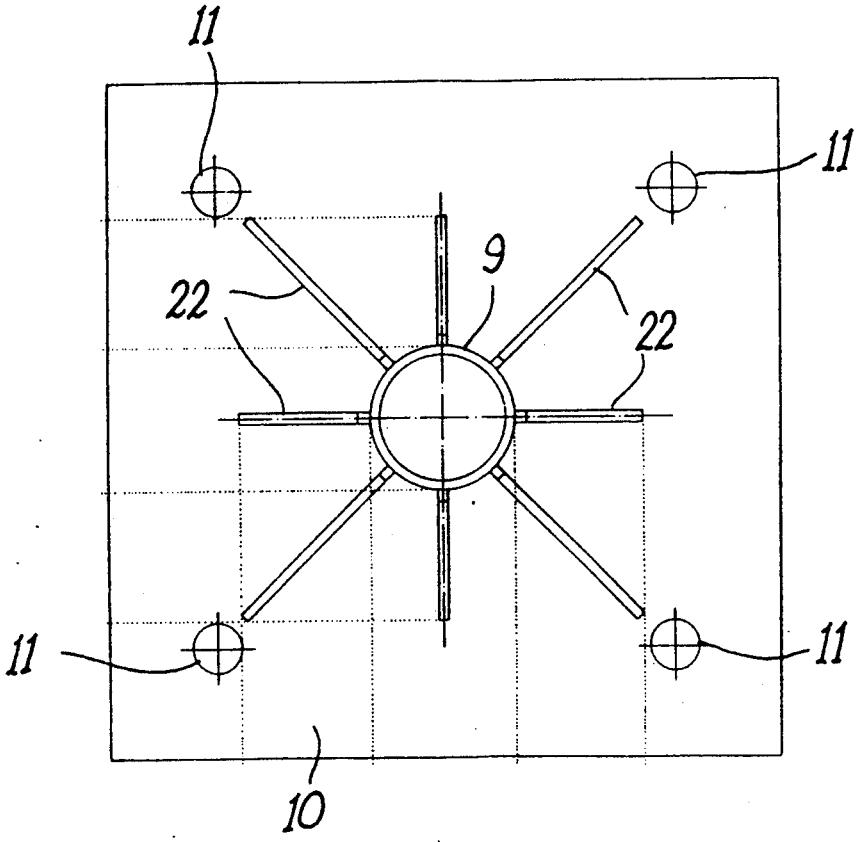
FIG. 8 is a top plan view of the base of FIG. 7.
Figure 9:
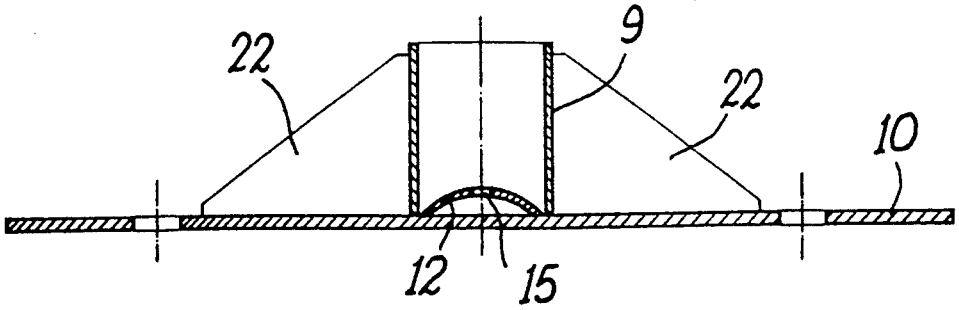
FIG. 9 is a longitudinal sectional view of the same base.
Figure 11:
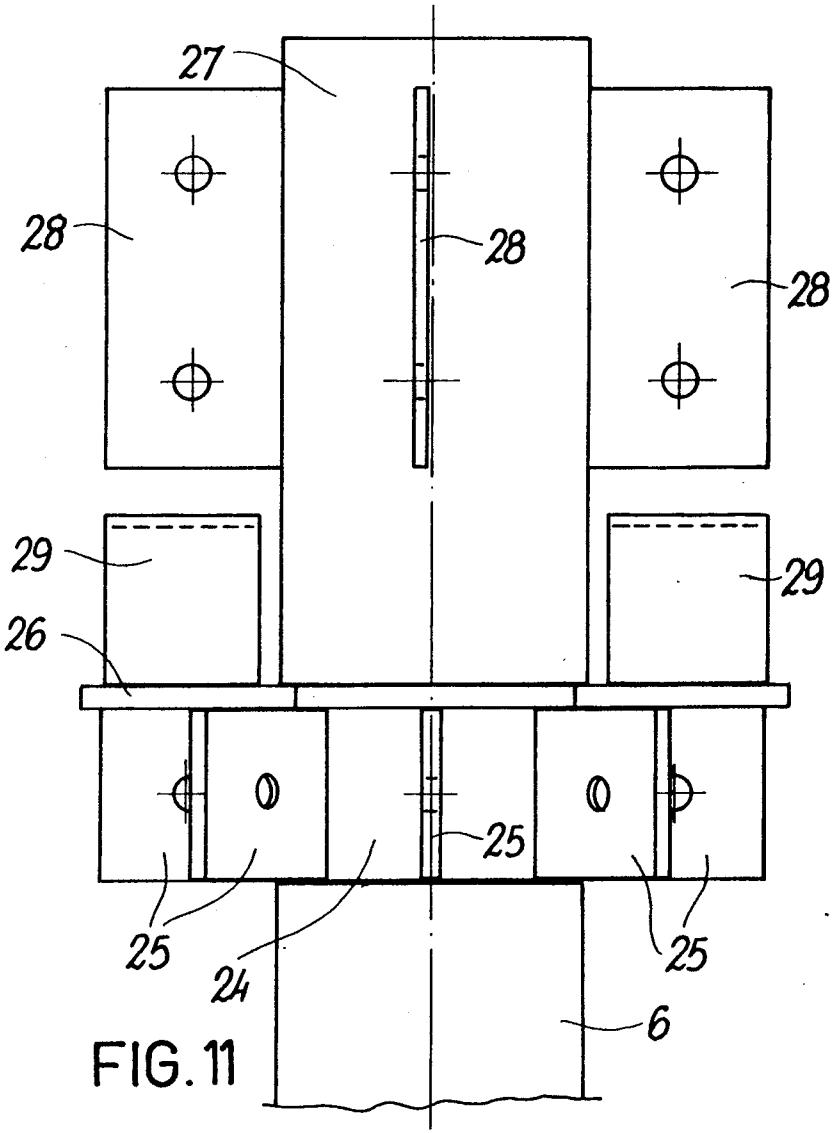
FIG. 11 is a different front elevation of the same node element.
Figure 10:
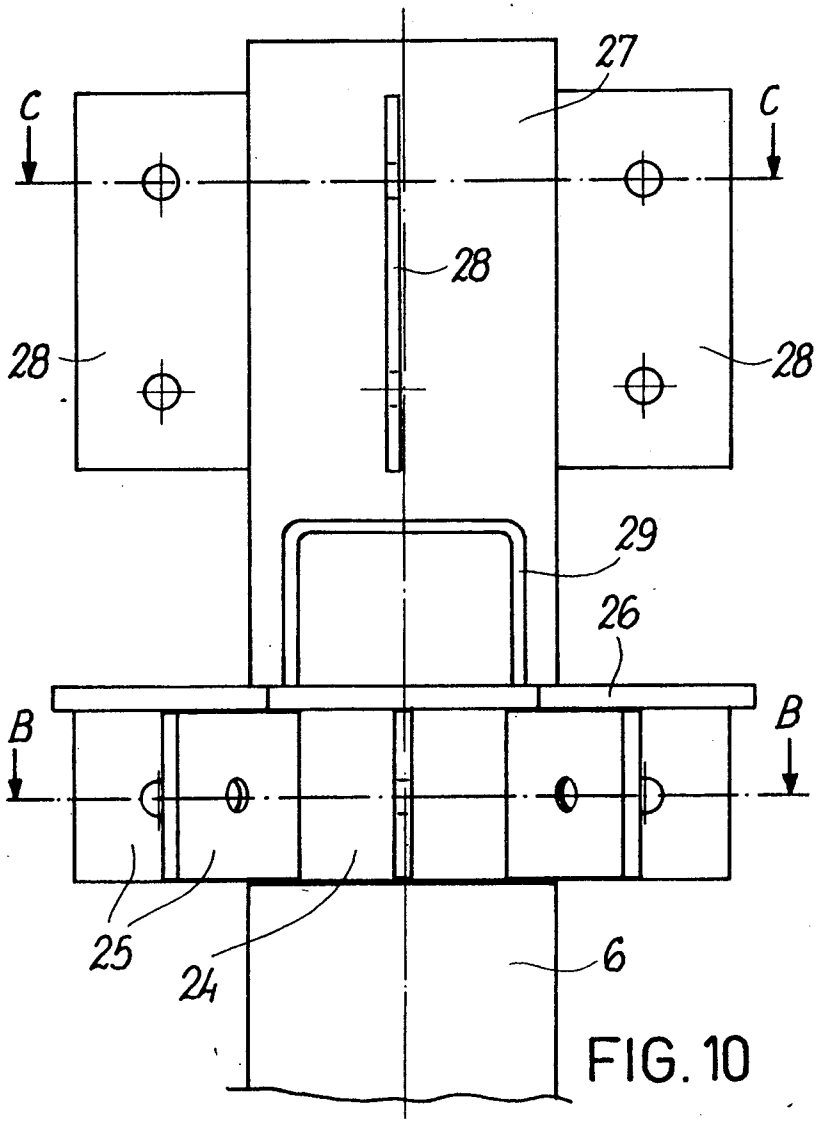
FIG. 10 is a front elevation of a preferred node element according to the invention.
Figure 12:
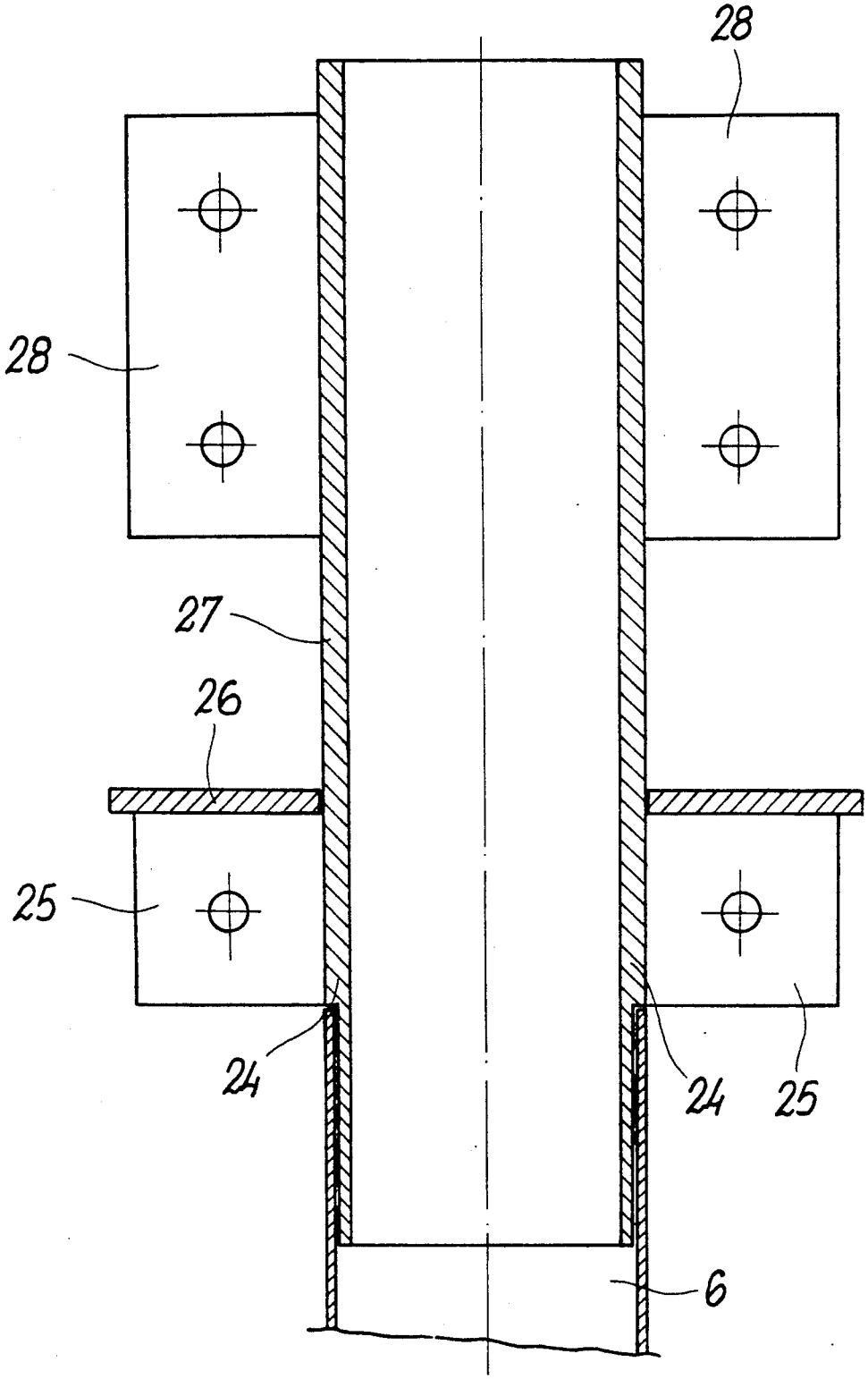
FIG. 12 is a longitudinal sectional view of the same node element.
Figure 13:
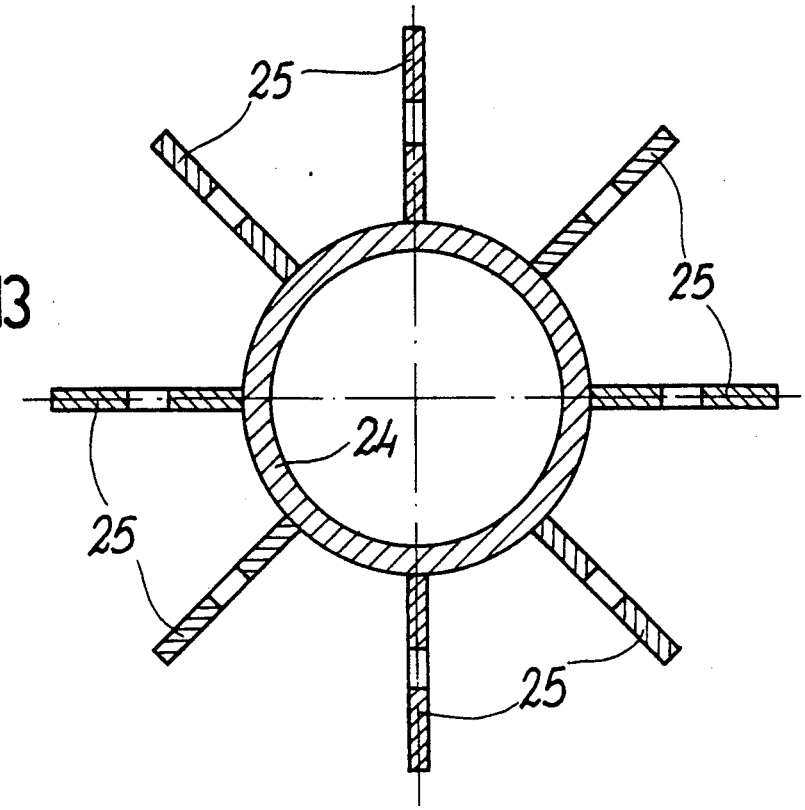
FIG. 13 is a cross-sectional view taken along line B—B of FIG. 10.

The last version of the base, shown in FIGS. 7 to 9 and in FIG. 3 (the FIGS. 7 to 9 not showing the upper part of the base, namely, the threaded pivot and sleeve, nor the hinge coupling) has eight separate reinforcing elements in the form of vertical plates 22, welded with one edge to the base plate 10 and with another, at right angles to the first one, to the external surface of the collar 9. Four of the said reinforcing plates 22 serve also as connection plates, as they are provided with a hole 23 for connection with the ties 8 and/or with struts.

It is evident that all the bases shown allow a rapid setting up of the structure of the invention and a complete adaptation of the same to he various conditions of the ground: while the base plates do not need to be perfectly horizontal, the pillars' vertical position is guaranteed, and their length can be adjusted on the spot, so as to absorb local differences of the ground's level.

Another preferred feature of the structure according to the invention is the design of the node elements 5, as shown in FIG. 3 and in FIGS. 10 to 14, all said figures showing the same embodiment.

The node element 5 comprises a lower tubular section 24, which fits in the upper hollow end of the pillar 6, and has, welded around its external surface, eight pierced connection plates 25 for connection with the bracing elements. A horizontal octagonal plate 26 is welded at the upper end of the said lower tubular section 24, the upper tubular section 27 being integral with the lower section 24.

Four connection plates 28 are welded around the external surface of the upper tubular section 27, each one having two holes for connection with the edge beams 4.

Figure 14:
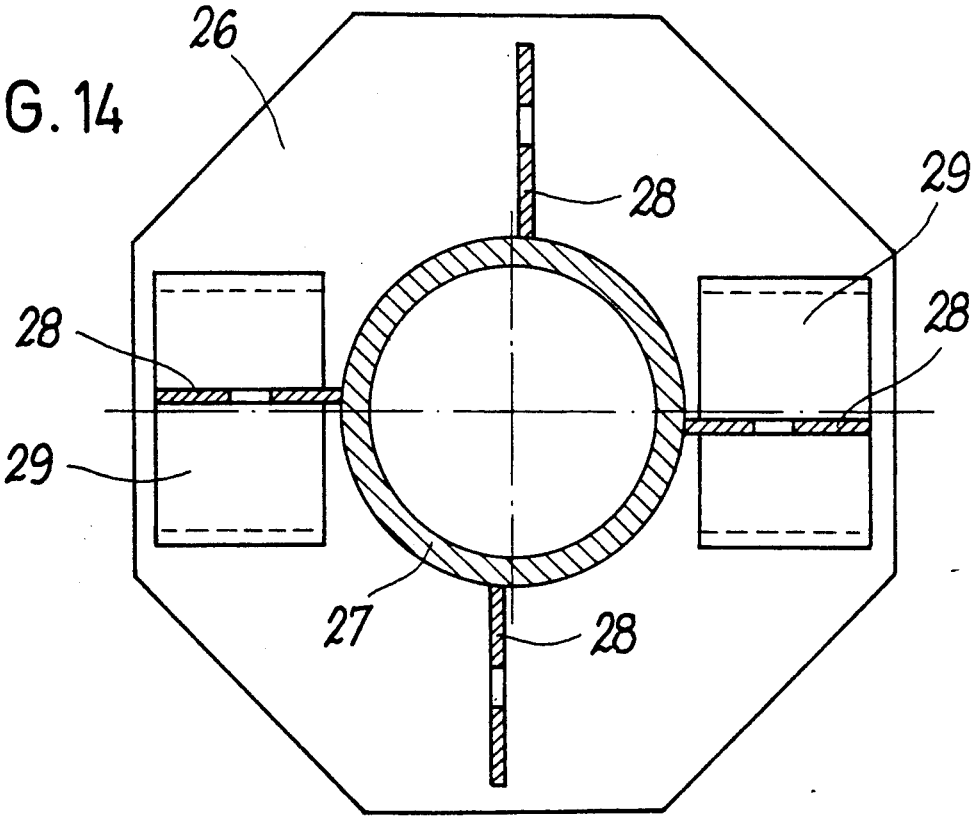
FIG. 14 is a cross-sectional view taken along line C—C of FIG. 10.

As it may be noted more clearly in the cross section of FIG. 14, the four connection plates 28 are slightly shifted with respect to the axial planes crossing at right angles shown by the broken lines: this allows the beam core to be exactly centered with respect to the node element 5 and the relevant supporting pillar 6.

The four edge beams 4 are connected to the node element 5 by simply laying the beam on the plate 26, coupling its core to the connection plate and connecting the two elements by means of nuts and bolts, as it is shown for the beams 4*a* in FIG. 3. If the beams 4 are all of the maximum size, no other elements are necessary, but if some of the beams converging on the node element are of a smaller size, an additional supporting element 29 is provided. In the case shown in the figures, two opposite beams (4*b* in FIG. 3) are of a smaller size, and they rest on the supporting elements 29, having the shape of a reversed U, with a flat upper surface. The two supporting elements 29 are welded to the plate 26. The cores of the smaller beams 4*b* are connected to the plates 28 in the same way as the larger beams 4*a*.

By adopting the node element of FIGS. 10 to 14, as already pointed out, a very simple series of operations for the assembly of the structure is required. The node element 5 may be placed on top of the pillar 6, and its orientation can be adjusted very simply by rotating it about its axis; thereafter, the beams 4 can be assembled in any order and, when assembled, they can be removed independently from the rest of the structure. The node elements are the same for any position in the structural plan, namely, for central, perimetral and corner positions, so that no special pieces are necessary.

FIG. 1 does not show the possible additional fittings that can complete the parking lot, but it is evident that elements such as safety fences, supports for lighting, transit bars, etc. can be added both at the upper and lower floor.

The structure according to the present invention allows many different parking configurations to be realized, according to the shape and the sizes of the area in question, to the chosen circulation pattern and to the position of the entrance or exit.

It is clear from the above that a modular structure like the one of the invention can be assembled and disassembled in very short times, thus allowing the construction of temporary parking lots at extremely low costs and, in addition, with the possibility of restoring the preceding ground situation very easily.

We claim:

1. A modular structure for parking lots, particularly suitable for temporary parking lots, comprising a number of basic modular units, each of said units, comprising a rectangular or square composite floor slab, four edge beams along the sides of said slab, four node elements at the corners of said slab, four vertical supporting elements below each of said node elements, and four bases below each of said vertical supporting members, characterized in that each of said units also comprises a number of ties and/or struts for bracing the structure, connected at their ends to said node elements and said bases, and in that each of said bases incorporates means for adjusting the total length of said vertical supporting elements, said adjustment means comprising a flat base plate, a cylindrical collar rigidly fixed in the centre of said base plate, the axis thereof being perpendicular to the plane of said plate, one or more reinforcing elements for stiffening the connection between said base plate and said collar, a first hinge member in the shape of a spherical segment with its convex side upwards, resting on said base plate within said cylindrical collar a cylindrical pivot externally threaded, of a smaller diameter than said cylindrical collar and having, at its lower end, a second hinge member in the shape of a spherical segment complementary to the first one and with its concave side downwards, said lower end of said cylindrical pivot being inserted in said cylindrical collar, and an internally threaded sleeve fitting said cylindrical pivot and coupled externally with the lower end of said vertical supporting element.

2. Modular structure according to claim 1, wherein each one of said node elements comprises a first tubular section coaxially insertable in the hollow upper end of the said vertical supporting element, having, regularly spaced out around its external surface, first pierced connection plates or eye hooks for connection with the said ties and/or struts, a horizontal plate for supporting said edge beams, fixed at the upper end of said first tubular section, and a second-tubular section over said plate, integral and coaxial with said first section, having second pierced connection plates for connection with the said edge beams, regularly spaced out around its external surface lying in vertical planes slightly shifted with respect to the axial planes.

3. Modular structure according to claims 1 or 2 wherein said one or more reinforcing elements of the base are four or more flat plates lying on symmetrically spaced axial planes, each one of said plates being welded with its lower edge to said flat base plate and with its vertical edge to the external surface of said cylindrical collar.

4. Modular structure according to claims 1 or 2, wherein said base also comprises third pierced connection plates or eye hooks, welded to the external surface of said cylindrical collar at its upper end, for connection with said ties and/or struts.

5. Modular structure according to claims 1 or 2 wherein said base also comprises an outer sleeve for protecting said threaded pivot and sleeve and the adjustable joint resulting therefrom, said outer sleeve being slidably coupled to the lower end of the said vertical supporting element and being sufficiently long as to completely cover the section between said lower end of the vertical supporting element and the said one or more reinforcing elements of the base.

6. Modular structure according to claims 1 or 2 wherein said flat base plate has two or more holes for connection to the ground.

7. Modular structure according to claims 1 or 2, wherein said node element also comprises, fixed onto said horizontal plate, one or more additional supporting elements, each one below one of said second pierced connection plates, with a flat upper surface for supporting edge beams having a cross-section smaller than the maximum one envisaged on the design.

8. Modular structure according to claim 7 wherein each of said additional supporting elements has the shape of a reversed U.

9. Modular structure according to claim 7 wherein there are two said additional supporting elements, each being welded below one of two opposite connection plates.

10. Modular structure according to claims 1 or 2, said structure also comprising one or more entrances and/or exit ramps.

11. Modular structure according to claims 1 or 2, claims said structure also comprising safety fences at the edges of the upper floor of said parking lot.

12. Modular structure according to any one of the preceding claims, said structure also comprising wheel stoppers or locking means for the vehicles on the upper floor of the said parking lot.

13. Modular structure according to claims 1 or 2, comprising support members for lighting.

14. Modular structure according to claims 1 or 2, wherein each of said one or more reinforcing elements of the base is in the form of a truncated cone having a central hole extending therethrough, said hole matching the cross sectional configuration of said cylindrical collar, and welded along its base perimeter to said flat base plate.

15. Modular structure according to claims 1 or 2, wherein each of said one or more reinforcing elements of the base is in the form of a truncated pyramid having a central hole extending therethrough, said hole matching the cross sectional configuration of said cylindrical collar, and welded along its base perimeter to said flat base plate.

16. Modular structure according to claims 1 or 2, wherein each of said one or more reinforcing elements of the base is in the form of a section of sphere having a central hole extending therethrough, said hole matching the cross sectional configuration of said cylindrical collar, and welded along its base perimeter to said flat base plate.

17. Modular structure according to claims 1 or 2, wherein each of said one or more reinforcing elements of the base is in the form of a section of ellipsoid having a central hole extending therethrough, said hole matching the cross sectional configuration of said cylindrical collar, and welded along its base perimeter to said flat base plate.

* * * * *